US005860727A

United States Patent [19]

Chien

[11] Patent Number: 5,860,727

[45] **Date of Patent: *Jan. 19, 1999**

[54] SHOE WITH AN ELECTRO-LUMINESCENT LIGHTING ELEMENT

[76] Inventor: Tseng-Lu Chien, Lin-Shen Road, Hseng, Taiwan

[ * ] Notice: The term of this patent shall not extend beyond the expiration date of Pat. No. 5,671,621.

[21] Appl. No.: 904,464

[22] Filed: Aug. 1, 1997

Related U.S. Application Data

[60] Continuation-in-part of Ser. No. 712,484, Sep. 11, 1996, Pat. No. 5,704,705, which is a division of Ser. No. 409,925, Mar. 23, 1995, Pat. No. 5,611,621, which is a continuation of Ser. No. 226,330, Apr. 12, 1994, abandoned.

[51] Int. Cl.[6] ..... A43B 21/00

[52] U.S. Cl. ..... 362/84; 362/103; 36/137

[58] Field of Search ..... 362/84, 103, 276, 362/802; 36/136, 137

[56] References Cited

U.S. PATENT DOCUMENTS

| | | | |
|---|---|---|---|
| 4,158,922 | 6/1979 | Dana, III | 362/103 |
| 5,188,447 | 2/1993 | Chiang et al. | 362/103 |

*Primary Examiner*—Thomas M. Sember
*Attorney, Agent, or Firm*—Bacon & Thomas, PLLC

[57] ABSTRACT

An illumination arrangement for a shoe includes a power supply and an electro-luminescent element which can be mounted on a surface of an upper portion of the shoe, or with a transparent area of the bottom portion of the shoe. The power supply, which includes a generator arranged to output power in response to motion of the shoe, may be mounted in the bottom of the shoe.

13 Claims, 4 Drawing Sheets

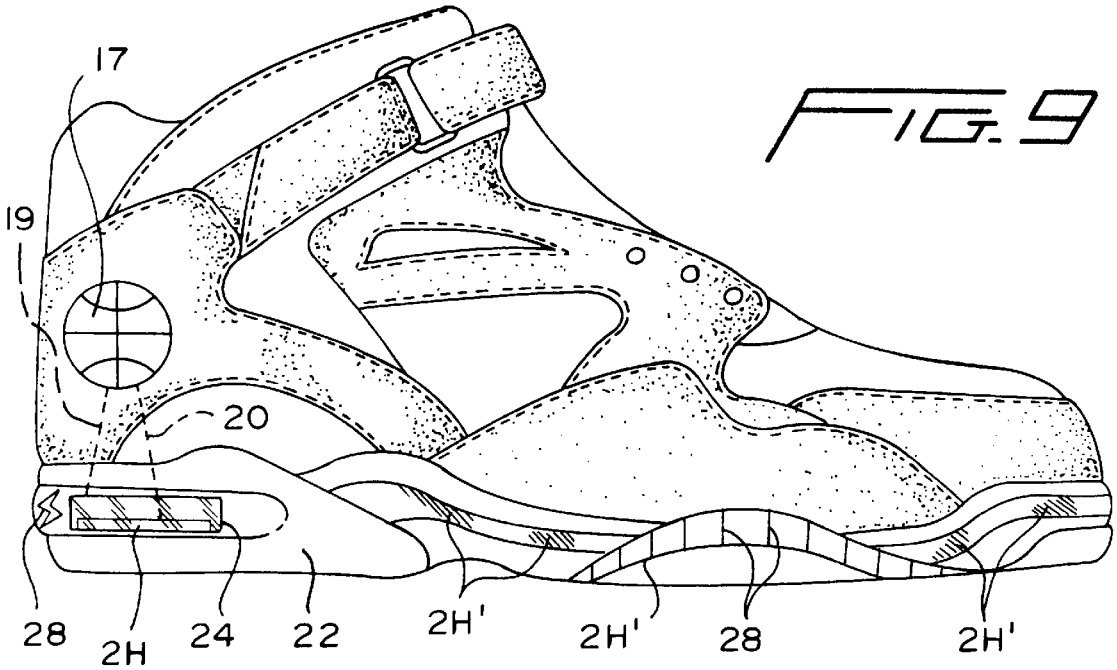
FIG. 9
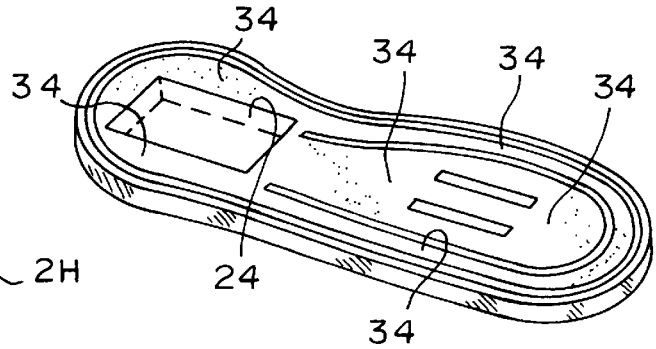
FIG. 6
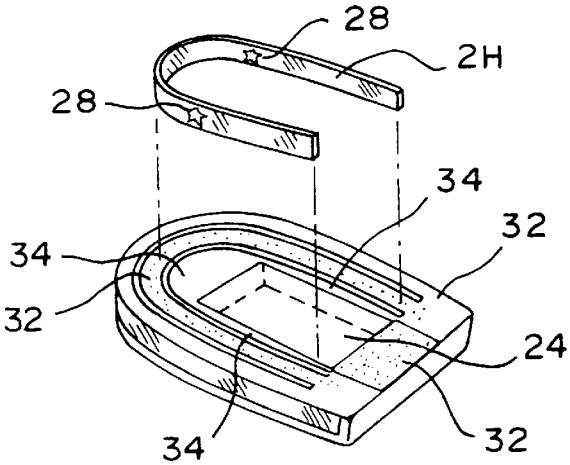
FIG. 8
FIG. 7
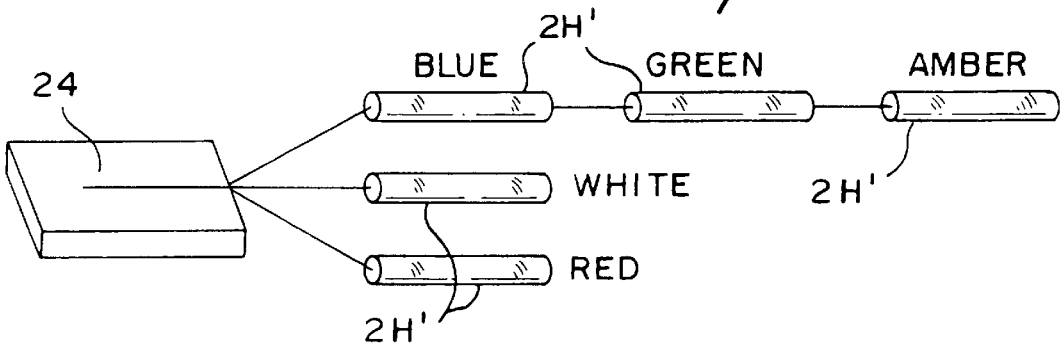

SHOE WITH AN ELECTRO-LUMINESCENT LIGHTING ELEMENT

This application is a Continuation-In-Part of U.S. patent application Ser. No. 08/712,484, now U.S. Pat. No. 5,704,705, filed Sep. 11, 1996, which is a Division of U.S. patent application Ser. No. 08/409,925, filed Mar. 23, 1995 (now U.S. Pat. No. 5,611,621), which is a Continuation of U.S. patent application Ser. No. 08/226,330, filed Apr. 12, 1994 now (abandoned).

BACKGROUND OF THE INVENTION

This invention relates to lighted shoes, and in particular to lighted shoes with electro-luminescent (electro-luminescent) lighting elements. Lighted shoes, such as shown in U.S. Pat. Nos. 3,893,247 and 3,946,505 have been provided in the past that include a flashing light. When an individual wearing the shoes moves back and forth, as during dancing or even while walking, a circuit provides certain functions such as flashing on and off. Such shoes are very useful and provide enhanced safety for many situations, but the conventional light sources are not as versatile or attractive as electro-luminescent lighting elements, which can have a variety of colors and can have a variety of shapes and configurations, including flat panels and three-dimensional fiber-like elements.

However, electro-luminescent lighting elements cannot simply be used in the conventional lighted shoes because of different electrical requirements. The conventional power supplies, such as shown in U.S. Pat. No. 4,158,922, which discloses a three position switch with different functions for triggering a light by D.C. power, lack components such as a transformer to supply A.C. power suitable for use in electro-luminescent applications, and thus the previous arrangements cannot easily be adapted for use with electro-luminescent lighting elements.

In addition, the use of batteries in the prior shoes is inconvenient in many situations, since batteries have a short lifespan and present a disposal problem.

SUMMARY OF THE INVENTION

The present invention uses an electro-luminescent lighting element triggered by electric pulses supplied by a power source at a certain frequency in place of the conventional D.C. powered flashing light. Rather than being limited to point sources, large areas of the shoe can be illuminated with different designs while still providing space to hide parts such as a coil and function interface. Furthermore, the improved lighting effects can be achieved using relatively simple assembly techniques such as stitching or glue, or other similar assembly methods.

In addition, the present invention provides an illuminated shoe having the above advantages and in which no batteries are used, power for the electro-luminescent elements instead being supplied by a generator arrangement in which the generator outputs current in response to motion of the shoe in which it is situated.

The invention thus provides an easier way to illuminate shoes by using a flexible tube or paper-thin electro-luminescent element or strip, examples of which are disclosed in the Inventor's U.S. Pat. No. 5,572,817, and in copending U.S. patent application Ser. Nos. 08/729,408 (Oct. 11, 1996), 08/734,872 (Oct. 22, 1996), 08/746,706 (Nov. 15, 1996), 08/758,393 (Nov. 29, 1996), 08/773,092 (Dec. 24, 1996), and 08/773,963 (Dec. 26, 1996)—after "strip". It can be put inside of a transparent heel or on the side of the shoe's surface or elsewhere. The lighting element is connected to a circuit which includes a generator arranged to output current upon movement of the shoe, and circuitry for forming the output of the generator into appropriate pulses capable of triggering the electro-luminescent element. An optional function interface, which can consist of conventional or integrated circuitry for providing appropriate driving signals, can be included to cause the electro-luminescent element to exhibit a variety of lighting effects, and the power supply can be connected to multiple lighting elements.

There are two principal ways to assemble the preferred light strip or strips to a shoe. One is for the heel and the other is for the side-surface of the shoe.

The heel type requires that some kind of transparent material be installed at the bottom of the shoe, and that the lighting element follow the contour of the bottom of the shoe or the shoe's heel. The lighting element can be put far away from the outside edge of the heel to create a shadow effect and increase brightness. This arrangement permits the entire contour of the shoe bottom to be lighted to improve the "narrow viewing angle" of any other light source. Also, the electro-luminescent lighting element or strips are unbreakable and fully waterproof, providing further advantages over conventional lights in this arrangement. Not only are such lighting elements durable, but they also have low power consumption comparable to that of an LED, and more color choices than any other light source, including green, blue, pink, purple, yellow, red, and turquoise. Hence, the appearance of the inventive lighting arrangement is much more attractive than that of other light sources. Still further, different colors can be put together for a rainbow effect, avoiding the limitation of LEDs to a red color, which should be reserved for police use. In the case of an illuminated heel design, all components are not only stored inside of the heel, but also positioned behind the lighting element to prevent the electrical components from blocking the light.

In the case of a surface application, the light strip or strips may be put into a transparent soft/stitchable material for surface mounting. The light strip can be silk-screen printed with transparent or non-transparent ink to obtain a much more attractive appearance for daytime or nighttime cosmetic purposes, and can be easily assembled to the shoe by Velcro™ hook and loop type fastener, double-sided tape, stitching, glue, or other conventional attachment means. This allows all outside surfaces of the shoes to be lighted for better safety.

It is therefore the primary objective of the present invention to provide useful illuminated shoes that utilize lights having superior flexibility and durability, lower power consumption, are easily manufactured, provide increased color choice, and can dispense with the need for batteries. This and other objects of the invention will become clear from an inspection of the detailed description of the invention and from the appended claims:

BRIEF DESCRIPTION OF THE DRAWINGS

FIG. 6 is a perspective view of a portion of a shoe bottom constructed according to the principles of the invention.

FIG. 7 is a schematic diagram showing a multiple electro-luminescent strip arrangement for use in connection with the preferred embodiments of the invention.

FIG. 8 is a side view showing the multiple strips of FIG. 7 applied to the shoe of FIG. 1.

FIG. 9 is a perspective view showing a bottom of the shoe illustrated in FIG. 8, with multiple strips.

DETAILED DESCRIPTION OF THE PREFERRED EMBODIMENTS

Figure 1:
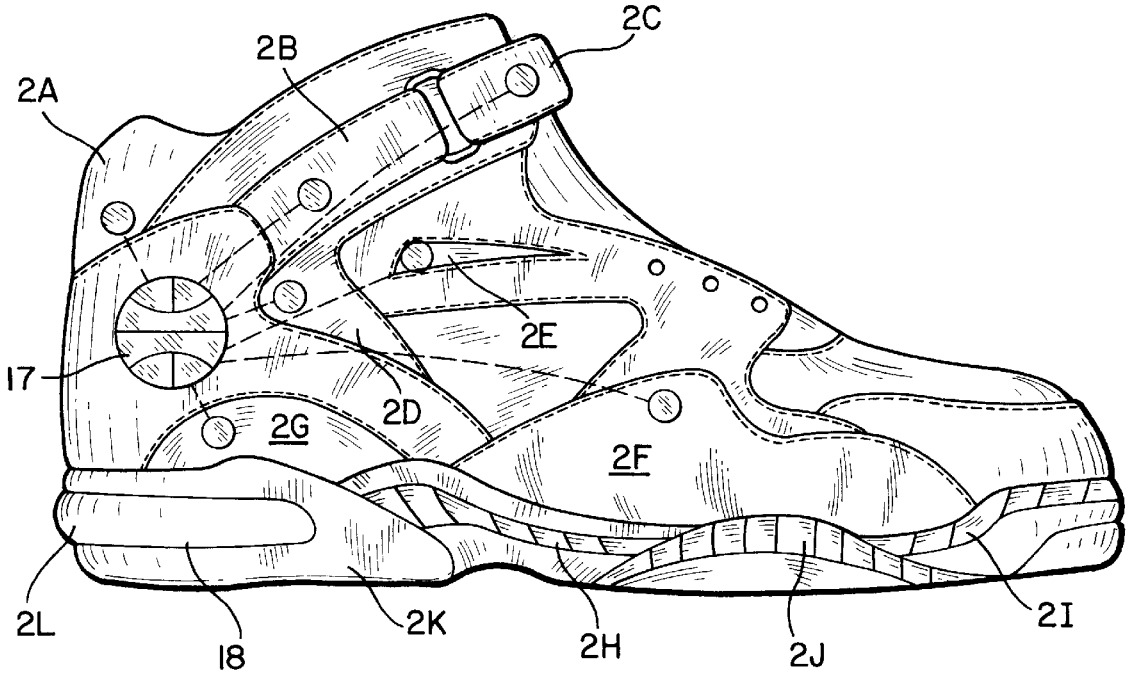
FIG. 1 is a side view of a shoe which uses a plurality of electro-luminescent lighting elements in accordance with the present invention.

Referring to FIG. 1, a sports shoe uses a plurality of electro-luminescent lighting elements which may be of the type described in the applicant's co-pending U.S. patent application Ser. No. 08/156,004. The electro-luminescent lighting elements such as 2A–2L are attached to the sports shoe by means of sewing, gluing, etc., and the electrical circuitry for the electro-luminescent lighting elements are located either in a portion of the bottom of the shoe indicated by part or wall 18 or in a housing 16 on the side of the shoe as described in more detail below.

Figure 2:
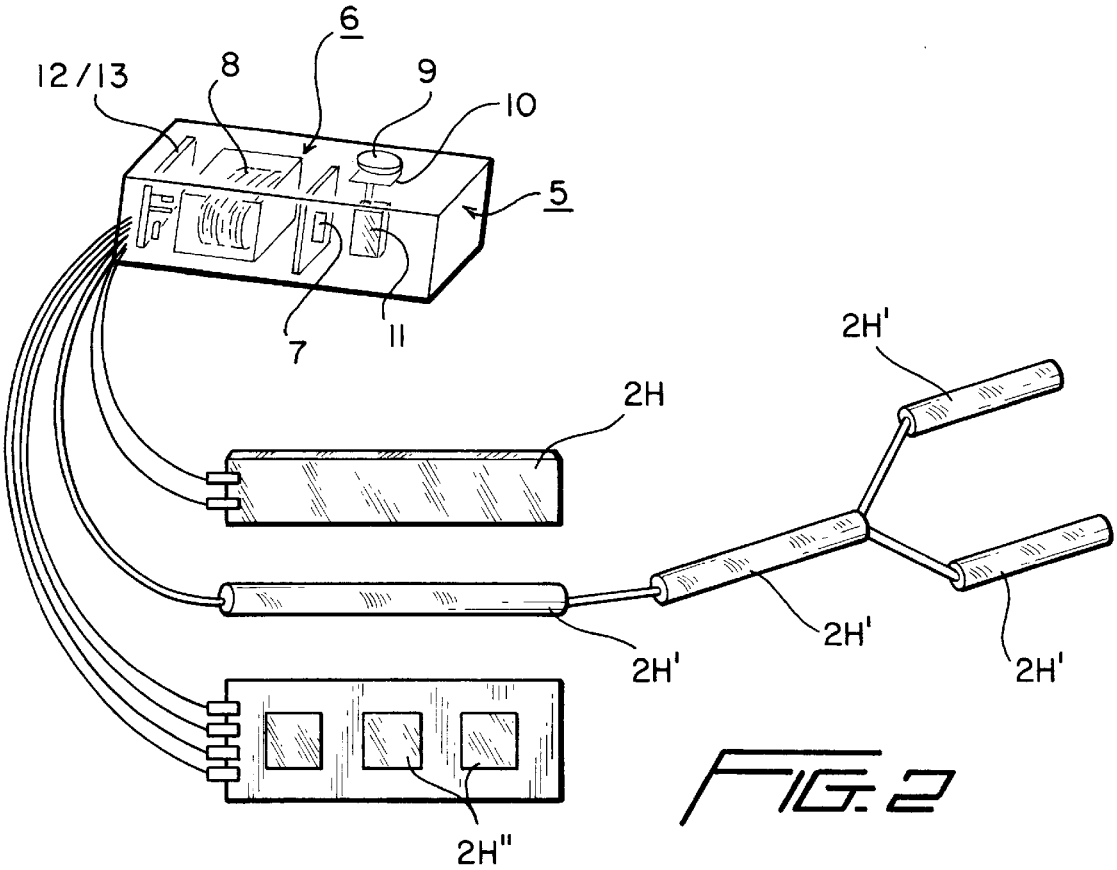
FIG. 2 is a perspective view of a power supply/trigger unit which includes a generator for supplying pulses of an appropriate voltage and frequency for triggering multiple electro-luminescent elements.
Figure 3:
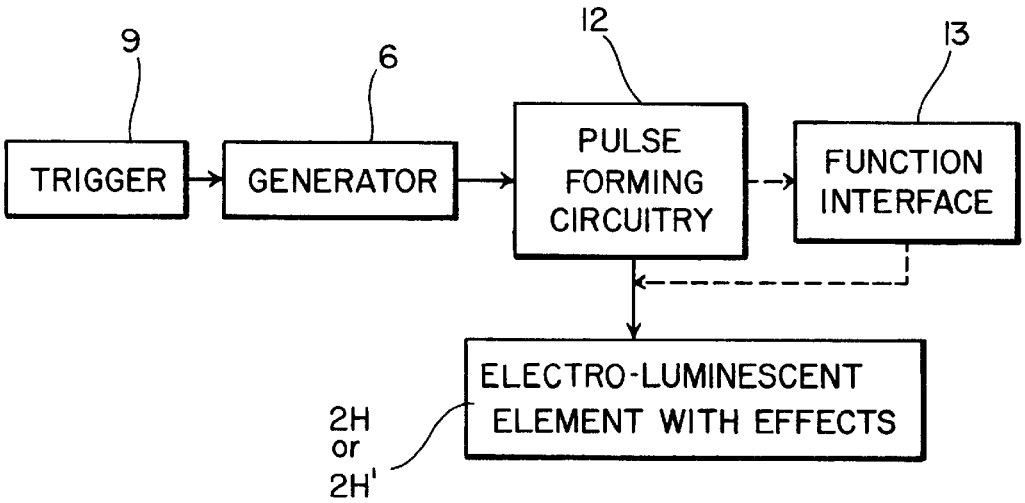
FIG. 3 is a functional block diagram of the power supply/trigger unit of FIG. 2.

The power for triggering the electro-luminescent lighting elements of FIG. 1 may be supplied by any source capable of converting power to pulses or waveforms of an appropriate frequency and voltage, or of generating such pulses. As illustrated in FIGS. 2 and 3, for example, the power is supplied by a generator/trigger unit 5 which includes a generator 6 made up of a magnetic member 7 positioned for movement within a coil 8 in response to motion of the shoe. Motion of the shoe may be transmitted to the magnetic member 7 by, for example, a step-trigger 9 biased by a spring 10 and having at one end a magnet 11 magnetically coupled with magnetic member 7 so that motion of the step trigger in response to motion of the shoe causes the magnetic member 7 to move relative to coil 8 and thereby generate a current. Spring 10 returns the step trigger to its original position in preparation for further motion of the shoe. It will of course be appreciated by the skilled artisan that other generator configurations may be substituted for the one illustrated herein.

The output of generator 6 is shaped and matched by conventional circuitry 12 in order to obtain the electro-luminescent trigger current. In addition, the power supply/trigger unit 5 can include circuitry for providing an optional function interface 13 which provides one or more different light functions depending on the desired lighting effects. For example, the function interface 13 which can be used to provide lighting effect options such as "regular short interval flashing", "permanent 'ON'", "regular short interval flashing interspersed with regular 'OFF' periods", "irregular interval flashing", and "phased-in and phased-out flashing," and which can be included in or combined with an integrated circuit or other conventional pulse or wave shaping circuitry or components.

As schematically illustrated in FIGS. 2, 7, and 8, a plurality of electro-luminescent strips 2H' can be connected to the power supply/trigger unit 5. These strips can have different colors and can be placed anywhere in the bottom or upper portion of the shoe. An example of a shoe bottom with multiple strips 2H' is shown in FIGS. 8 and 9. In addition, panels having multiple segments 2H" may be connected to the power supply/trigger unit.

Those skilled in the art will appreciate that the electro-luminescent lighting elements can be turned on and off by means of an optional switch (not shown), which can be a push-button switch or other type of switch, such as a photosensitive switch. In the case of a push button switch, the switch can be placed in any convenient location, such as within the elastic semi-spherical cover 17 shown in FIGS. 1 and 5, which can easily be pressed by the user. In this arrangement, a pattern may be formed or printed on the external surface of the elastic semi-spherical cover 17 so that the elastic semi-spherical cover 17 looks like a ball.

In any of the illustrated embodiments, the power supply/trigger unit 5 may be placed in the bottom of the shoe or at any other convenient location on the show. In the case where a switch is provided at the location of cover 17, the function interface 13 may be connected to the switch within the cover by means of wires 19, and connected to an electro-luminescent lighting element 2H by means of wires 20.

Figure 4A:
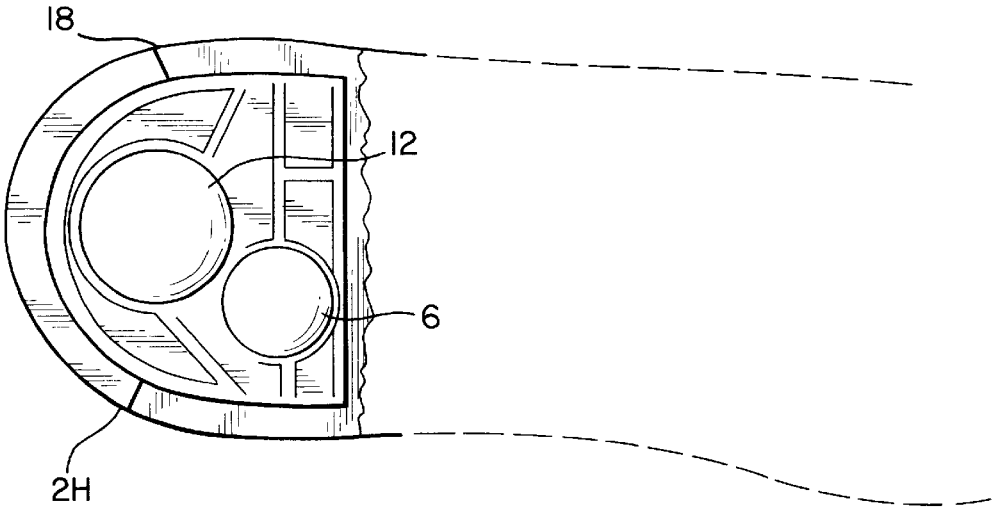
FIG. 4A is a bottom view of a shoe which uses a second embodiment of the circuit shown in FIG. 3.
Figure 5:
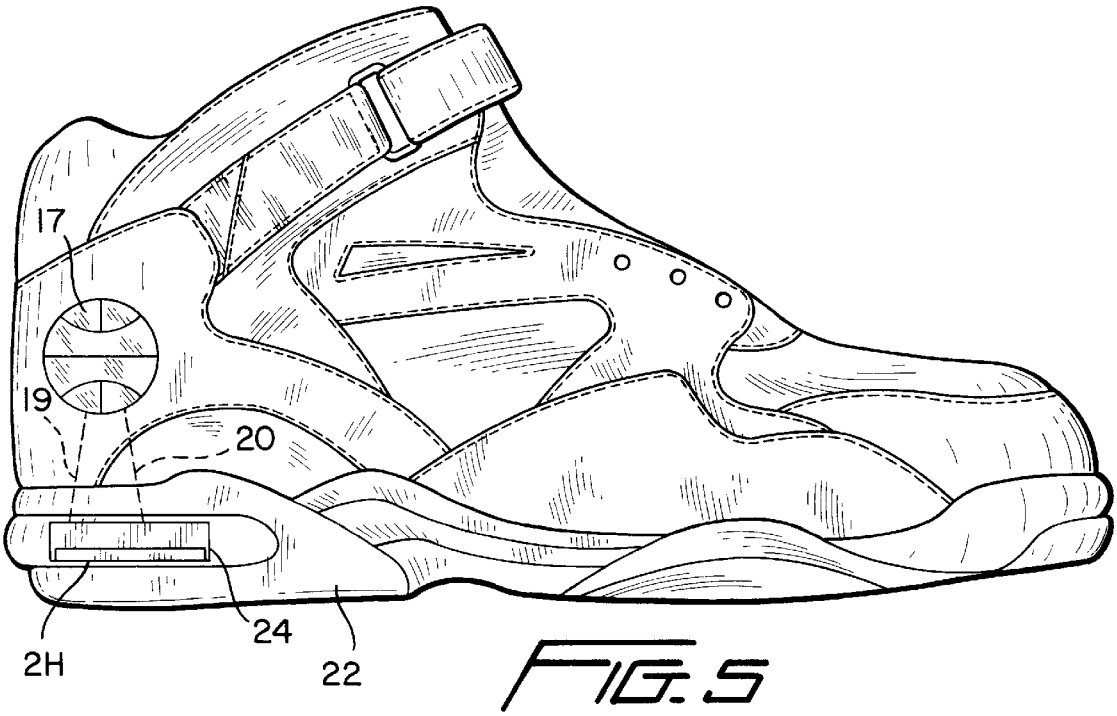
FIG. 5 is a side view of a variation of the shoe of FIG. 1.

In the embodiment illustrated in FIGS. 4A and 5, the power supply/trigger unit 5 and the electro-luminescent lighting element 2H are both mounted in the bottom of a sports shoe by defining a power pack 24, which contains unit 5, in one side of hollow sports shoe heel 22 and covering the power pack with the electro-luminescent strip 2H. Thus, light which is emitted by the electro-luminescent lighting element 2H is visible through transparent part or wall 18 from the exterior of the sports shoe heel 22. On the other hand, if the power source and circuit components are situated in the bottom of the shoe but the electro-luminescent strips are on the upper surface of the shoe, then part or wall 18 does not need to be transparent.

Figure 4B:
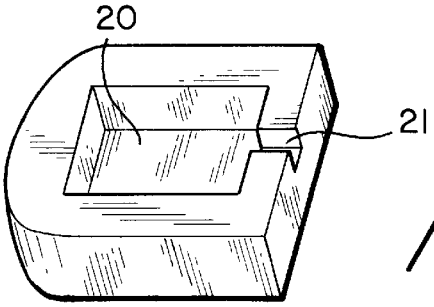
FIG. 4B is a perspective view of a portion of a shoe bottom constructed in accordance with the principles of a preferred embodiment of the invention.

As shown in FIG. 4B, the generator and other power components or circuitry of the power supply/trigger unit may be housed in an opening 20 in a portion of the shoe bottom having a groove 21 for enabling passage of wires to lighting elements situated outside the opening.

FIG. 6 shows the electro-luminescent strip 2H, transparent area 18, and power pack 24 mentioned above, before insertion of the electro-luminescent strip. In addition, in this perspective view, the electro-luminescent strip 2H can be seen to include screen printing 28 (see FIG. 8), which may be in the form of solid or transparent ink, and solid supports 34 for strengthening the hollow transparent portion of the shoe bottom housing power pack 24 and electro-luminescent strip 2H can be seen. A layer of glue or double sided adhesive tape 32 may be placed on a top surface of the solid supports and/or at the periphery of the structure to attach it to the shoe, also as shown in FIG. 6.

Having thus described a preferred embodiment of the invention in detail so as to enable those skilled in the art to make and use the invention, it will be appreciated that numerous variations and modifications are possible within the scope of the invention. As a result, it is intended that the invention be interpreted solely in accordance with the appended claims.

I claim:

1. In a shoe, comprising:

a shoe bottom;

a upper shoe surface connected to the shoe bottom;

a lighting arrangement; and a power supply for supplying power to energize the lighting arrangement, the improvement comprising:

an electro-luminescent element;

a generator included in said power supply;

means for forming an output of said generator which is capable of activating the electro-luminescent element;

means for enclosing the generator within the shoe bottom; and means for attaching the electro-luminescent element to the soft upper surface of the shoe.

2. A shoe as claimed in claim 1, further comprising a plurality of additional electro-luminescent elements.

3. A shoe as claimed in claim 2, wherein the plurality of additional electro-luminescent elements are of different colors.

4. A shoe as claimed in claim 1, further comprising a function interface in the form of conventional or integrated circuitry for providing a plurality of lighting effects, including lighting effects selected from the group consisting of sequential, chasing, random, fade-in fade-out, pair flashing, multiple flashing, and other light performance effects having a predetermined on-off timing and duty cycle.

5. A shoe as claimed in claim 4, further comprising a function interface in the form of conventional or integrated circuitry for providing a plurality of lighting effects, including lighting effects selected from the group consisting of sequential, chasing, random, fade-in fade-out, pair flashing, multiple flashing, and other light performance effects having a predetermined on-off timing and duty cycle.

6. A shoe as claimed in claim 4, further comprising a plurality of solid supports formed in the hollow at least partially transparent shoe heel for strengthening the hollow at least partially transparent shoe heel.

7. In a shoe, comprising:

a shoe bottom;

an upper shoe surface connected to the shoe bottom;

a lighting arrangement; and a power supply for supplying power to energize the lighting arrangement, the improvement comprising:

an electro-luminescent element;

a generator in said power supply;

means for forming an output of said generator capable of activating the electro-luminescent element; and means including a hollow at least partially transparent shoe heel fixed in the shoe bottom for enclosing the electro-luminescent element and the generator within the shoe bottom, said hollow transparent shoe heel including an exterior surface and a relatively outer portion that is inside the exterior surface but situated closer to the exterior surface than a relatively inner portion of the transparent shoe heel, wherein the electro-luminescent element is located in the relatively outer portion of the hollow transparent shoe heel and the generator is located in the relatively inner portion of the hollow transparent shoe heel so that light emitted from the electro-luminescent element is visible from a periphery of the hollow transparent shoe heel.

8. A shoe as claimed in claim 7, further comprising a plurality of additional electro-luminescent elements.

9. A shoe as claimed in claim 8, wherein the plurality of additional electro-luminescent elements are of different colors.

10. In a shoe, comprising:

a shoe bottom;

an upper shoe surface connected to the shoe bottom;

a lighting arrangement; and a power supply;

the improvement wherein:

the power supply is a generator arranged to convert mechanical energy resulting from motion of the shoe into electrical energy, and the lighting arrangement includes an electro-luminescent element and circuitry arranged to shape the electrical energy output by the generator into an AC current having a magnitude and frequency sufficient to trigger the electro-luminescent element and cause it to illuminate, the shoe bottom includes at least one transparent area, and the electro-luminescent element is substantially fixed within the shoe bottom and light emitted from the electro-luminescent element is visible through the at least one transparent area.

11. A shoe as claimed in claim 10, further comprising at least one additional transparent area and at least one additional electro-luminescent elements visible through said at least one additional transparent area.

12. A shoe as claimed in claim 11, wherein said first and additional electro-luminescent elements are of different colors.

13. A shoe as claimed in claim 10, further comprising a function interface in the form of conventional or integrated circuitry for providing a plurality of lighting effects, including lighting effects selected from the group consisting of sequential, chasing, random, fade-in fade-out, pair flashing, multiple flashing, and other light performance effects having a predetermined on-off timing and duty cycle.

* * * * *